US005398662A

United States Patent [19]

Igarashi et al.

[11] Patent Number: 5,398,662

[45] Date of Patent: Mar. 21, 1995

[54] EVAPORATIVE FUEL-PROCESSING SYSTEM FOR INTERNAL COMBUSTION ENGINES FOR VEHICLES

[75] Inventors: Hisashi Igarashi; Masataka Chikamatsu; Hiroshi Maruyama; Masayoshi Yamanaka, all of Wako, Japan

[73] Assignee: Honda Giken Kogyo Kabushiki Kaisha, Tokyo, Japan

[21] Appl. No.: 20,838

[22] Filed: Feb. 22, 1993

[30] Foreign Application Priority Data

Mar. 2, 1992 [JP] Japan ..... 4-080484

[51] Int. Cl.[6] ..... F02M 37/04

[52] U.S. Cl. ..... 123/520; 123/198 D

[58] Field of Search ..... 123/520, 519, 518, 516, 123/521, 198 D

[56] References Cited

U.S. PATENT DOCUMENTS

| | | | |
|---|---|---|---|
| 5,158,059 | 10/1992 | Kuroda | 123/520 |
| 5,193,512 | 3/1993 | Steinbrenner | 123/520 |
| 5,197,442 | 3/1993 | Blumenstock | 123/520 |
| 5,220,896 | 6/1993 | Blumenstock | 123/520 |
| 5,228,421 | 7/1993 | Orzel | 123/520 |

*Primary Examiner*—Carl S. Miller

*Attorney, Agent, or Firm*—Nikaido, Marmelstein, Murray & Oram

[57] ABSTRACT

An evaporative fuel-processing system for an internal combustion engine, incorporates an evaporative emission control system in which a first control valve is arranged across an evaporative fuel-guiding passage extending between a fuel tank and a canister, a second control valve across a purging passage extending between the canister and the intake system of the engine, and a third control valve at an air inlet port of the canister, respectively. An ECU generates operation command signals to the first to third control valves for closing or opening the same to bring the evaporative emission control system into a predetermined negatively pressurized state. The ECU is responsive to an output from a parameter sensor which detects at least one of vehicle speed, temperature within the fuel tank, and an amount of fuel within the fuel tank, for determining whether there is an abnormality in the evaporative emission control system, based upon an output from a tank internal pressure sensor. The output is obtained when the evaporative emission control system has been brought into the predetermined negatively pressurized state, when the value of at least one parameter detected by the parameter sensor falls within a predetermined range.

18 Claims, 12 Drawing Sheets

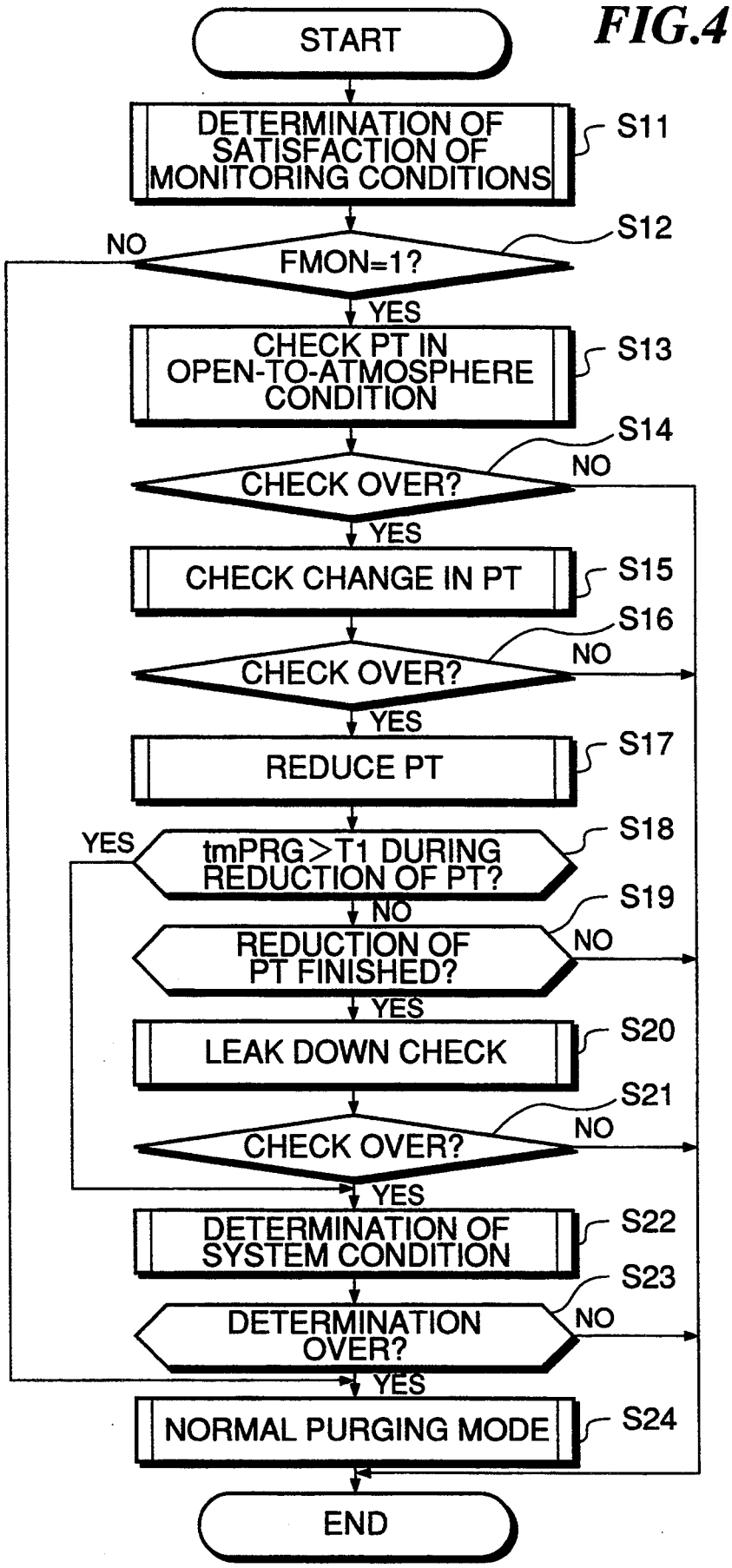
FIG.4
START
DETERMINATION OF SATISFACTION OF MONITORING CONDITIONS
S11
FMON=1?
S12
NO
YES
CHECK PT IN OPEN-TO-ATMOSPHERE CONDITION
S13
CHECK OVER?
S14
NO
YES
CHECK CHANGE IN PT
S15
CHECK OVER?
S16
NO
YES
REDUCE PT
S17
tmPRG>T1 DURING REDUCTION OF PT?
S18
YES
NO
REDUCTION OF PT FINISHED?
S19
NO
YES
LEAK DOWN CHECK
S20
CHECK OVER?
S21
NO
YES
DETERMINATION OF SYSTEM CONDITION
S22
DETERMINATION OVER?
S23
NO
YES
NORMAL PURGING MODE
S24
END

EVAPORATIVE FUEL-PROCESSING SYSTEM FOR INTERNAL COMBUSTION ENGINES FOR VEHICLES

BACKGROUND OF THE INVENTION

1. Field of the Invention

This invention relates to an evaporative fuel-processing system for internal combustion engines for vehicles, and more particularly to an evaporative fuel-processing system which has a function of detecting abnormalities in an evaporative emission control system of the engine.

2. Prior Art

Conventionally, there has been widely used an evaporative fuel-processing system for internal combustion engines for automotive vehicles, which comprises an evaporative emission control system having a canister with an air inlet port provided therein, a first control valve arranged across an evaporative fuel-guiding passage extending between a fuel tank of the engine and the canister, and a second control valve arranged across a purging passage extending between the canister and an intake system of the engine.

An evaporative emission control system of this kind temporarily stores evaporative fuel in the canister, and then purges the evaporative fuel into the intake system of the engine.

Whether an evaporative emission control system of this kind is normally operating can be checked, for example, by bringing the evaporative emission control system into a predetermined negatively pressurized state, measuring a change in the pressure within the fuel tank (tank internal pressure) occurring with the lapse of time after the evaporating emission control system has been brought into the predetermined negatively pressurized state, by a tank internal pressure sensor which detects the tank internal pressure, and determining whether the system is normally operating, from the measured tank internal pressure, as proposed by Japanese Patent Application No. 3(1991)-262857 and corresponding U.S. Ser. No. 07/942,875 assigned to the assignee of the present application, for example.

According to the method of the earlier application, an amount of change in pressure prevailing within the evaporative emission control system is detected by the tank internal pressure sensor, to determine an abnormality in the system in such a manner that if the detected pressure change amount is below a predetermined value, it is presumed that an amount of evaporative fuel leaking from the system to the outside is small and hence it is determined that the system is normally functioning, whereas if the detected pressure change amount exceeds the predetermined value, it is presumed that evaporative fuel is leaking in a large amount from the system to the outside, and hence it is determined that the system is malfunctioning.

The abnormality detecting method according to the earlier application still has room for further improvement, as follows:

The upper surface of fuel within the fuel tank largely moves or stirs when the vehicle is in a particular running condition such as acceleration, deceleration and turning. Consequently, the pressure within the fuel tank largely changes when the vehicle is in such a particular running condition. Besides, when the upper surface of fuel within the fuel tank largely moves, evaporative fuel can be generated in large amounts.

Further, the amount of evaporative fuel generated within the fuel tank can vary depending upon temperature within the fuel tank and an amount of fuel stored in the fuel tank.

A change in the pressure within the fuel tank and generation of a large amount of evaporative fuel in the fuel tank affects the rate of change in the tank internal pressure which occurs with the lapse of time after the evaporative emission control system has been negatively pressurized, which causes an error in the abnormality determination.

However, in the above-mentioned abnormality detecting method according to the earlier application, determination of the abnormality of the evaporative emission control system is made based upon the amount of change in the tank internal pressure or the amount of evaporative fuel generated within the fuel tank. Therefore, when the pressure within the fuel tank largely changes or when a large amount of evaporative fuel is generated in the fuel tank, due to the running of the vehicle in such a particular running condition as mentioned above, etc., it can be erroneously determined that the system is abnormal even when it is functioning normally.

SUMMARY OF THE INVENTION

It is the object of the invention to provide an evaporative fuel-processing system for an internal combustion engine for vehicles, which is capable of accurately detecting abnormalities in an evaporative emission control system of the engine to thereby avoid an erroneous determination as to an abnormality in the evaporative emission control system.

To attain the object, the present invention provides an evaporative fuel-processing system for an internal combustion engine installed in a vehicle and having an intake system, and a fuel tank, the system comprising an evaporative emission control system including a canister having an air inlet port provided therein, an evaporative fuel-guiding passage extending between the fuel tank and the canister, a first control valve arranged across the evaporative fuel-guiding passage, a purging passage extending between the canister and the intake system of the engine, and a second control valve arranged across the purging passage.

The evaporative fuel-processing system according to the invention is characterized by comprising:

- tank internal pressure detecting means for detecting pressure within the fuel tank;
- negatively pressurizing means for bringing the evaporative emission control system into a predetermined negatively pressurized state;
- parameter detecting means for detecting a value of at least one of a parameter representative of a running condition of the vehicle and at least one parameter representative of an internal state of the fuel tank, the parameters affecting pressure within the fuel tank and generation of evaporative fuel within the fuel tank; and
- abnormality determining means responsive to an output from the parameter detecting means, for detecting an abnormality in the evaporative emission control system, based upon an output from the tank internal pressure detecting means, which is obtained when the evaporative emission control system has been brought into the predetermined negatively pressurized state, when the value of the at least one of the parameters detected by the parameter detecting means falls within a predetermined range.

Preferably, the parameter representative of the running condition of the vehicle includes the traveling speed of the vehicle, and wherein the abnormality determining means carries out the abnormality determination when it is detected from an output from the vehicle speed detecting means that the vehicle is standing, for example, thus avoiding an erroneous abnormality determination which would otherwise be caused by a change in the pressure within the fuel tank due to movement of the upper surface of fuel within the fuel tank.

Also preferably, the at least one parameter representative of the internal state of the fuel tank includes temperature within the fuel tank, and wherein the abnormality determining means carries out the abnormality determination when it is detected from an output from the tank temperature detecting means that the interior of the fuel tank is in a predetermined cold state wherein evaporative fuel is not generated in large amounts due to the low temperature of the fuel within the fuel tank, thus avoiding an erroneous abnormality determination.

Further preferably, the at least one parameter representative of the internal state of the fuel tank includes the amount of fuel within the fuel tank, and wherein the abnormality determining means carries out the abnormality determination when it is detected from an output from the fuel amount detecting means that the amount of fuel within the fuel tank falls within a predetermined range within which a proper change can occur in the pressure within the fuel tank, thus avoiding an erroneous abnormality determination.

Further, the evaporative fuel-processing system may include engine operation detecting means for detecting whether the engine is operating, and a third control valve for opening and closing the air inlet port of the canister, and wherein the negatively pressurizing means brings the evaporative emission control system into the predetermined negatively pressurized state by controlling the first to third control valves while the engine is detected to be operating. As a result, the evaporative emission control system can be brought into the predetermined negatively pressurized state, merely by controlling the first to third control valves.

Still further, the abnormality determining means determines abnormality of the evaporative emission control system, based upon a rate of change in the pressure within the fuel tank occurring with the lapse of time after the evaporative emission control system has been brought into the predetermined negatively pressurized state by the negatively pressurizing means.

More preferably, the abnormality determining means compares the rate of change in the pressure within the fuel tank with the lapse of time with a predetermined value which is set depending upon an amount of fuel within the fuel tank, and determines whether or not the evaporative emission control system is abnormal, based upon a result of the comparison. As a result, the abnormality determination can be carried out with accuracy in response to the volume of an evaporative fuel layer formed within the fuel tank which affects a change in the pressure within the fuel tank occurring with the lapse of time after the evaporative emission control system has been negatively pressurized.

The above and other objects, features, and advantages of the invention will be more apparent from the following detailed description taken in conjunction with the accompanying drawings.

BRIEF DESCRIPTION OF THE DRAWINGS

FIG. 4 is a flowchart showing a routine for determining an abnormality in the evaporative emission control system appearing in FIG. 1;

DETAILED DESCRIPTION

The invention will now be described in detail with reference to the drawings showing an embodiment thereof.

Figure 1:
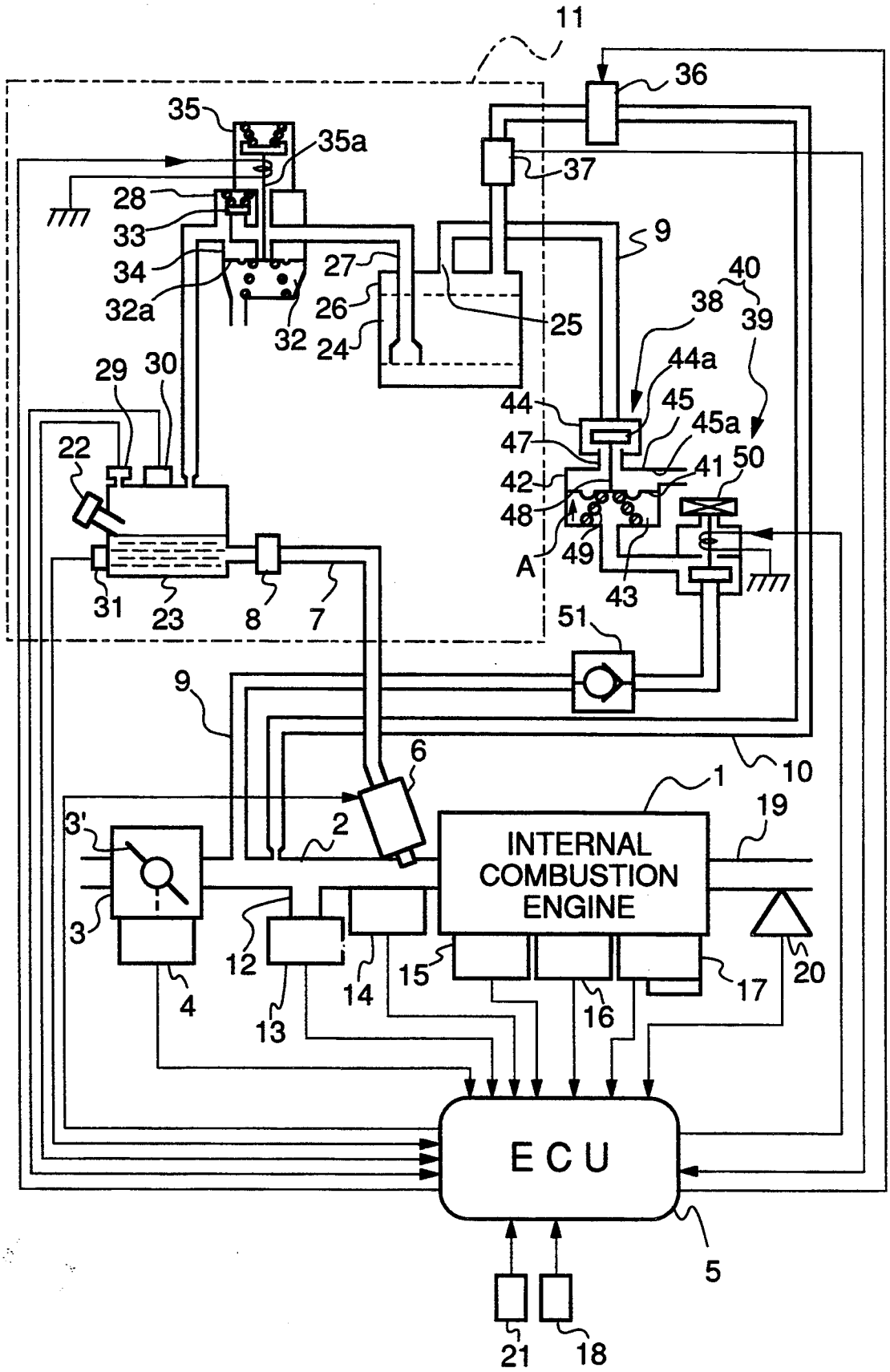
FIG. 1 is a block diagram showing the whole arrangement for an internal combustion engine and an evaporative fuel-processing system therefor, according to an embodiment of the invention.

Referring first to FIG. 1, there is illustrated the whole arrangement of an internal combustion engine installed in an automotive vehicle and an evaporative fuel-processing system therefor according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7, and electrically connected to the ECU 5 to have their valve opening periods controlled by signals therefrom.

A negative pressure communication passage 9 and a purging passage 10 open into the intake pipe 2 at respective locations downstream of the throttle valve 3', both of which are connected to an evaporative emission control system 11, referred to hereinafter.

Further, an intake pipe absolute pressure (PBA) sensor 13 is provided in communication with the interior of the intake pipe 2 via a conduit 12 opening into the intake passage 2 at a location downstream of an end of the purging passage 10 opening into the intake pipe 2 for supplying an electrical signal indicative of the sensed absolute pressure within the intake pipe 2 to the ECU 5.

An intake air temperature (TA) sensor 14 is inserted into the intake pipe 2 at a location downstream of the conduit 12 for supplying an electrical signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electrical signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

A transmission 17 is connected between wheels of a vehicle, not shown, and an output shaft of the engine 1, for transmitting power from the engine 1 to the wheels.

A vehicle speed (VSP) sensor 18 is mounted on one of the wheels, for supplying an electric signal indicative of the sensed vehicle speed VSP to the ECU 5.

An oxygen concentration ($O_2$) sensor 20 is inserted into an exhaust pipe 19 extending from the engine 1, for supplying an electrical signal indicative of the sensed oxygen concentration to the ECU 5.

An ignition switch (IGSW) sensor 21 detects an ON (or closed) state of an ignition switch IGSW, not shown, to detect that the engine 1 is in operation, and supplies an electrical signal indicative of the ON state of the ignition switch IGSW to the ECU5.

A fuel tank 23 having a filler cap 22 which is removed for refueling is provided in the vehicle.

The evaporative emission control system 11 is comprised of a canister 26 containing activated carbon 24 as an adsorbent and having an air inlet port 25 provided in an upper wall thereof, an evaporative fuel-guiding passage 27 connecting between the canister 26 and the fuel tank 23, and a first control valve 28 arranged across the evaporative fuel-guiding passage 27.

The fuel tank 23 is connected to the fuel injection valves 6 via the fuel pump 8 and the fuel supply pipe 7, and has a tank internal pressure (PT) sensor (hereinafter referred to as "the PT sensor") 29 and a fuel amount (FV) sensor 30, both mounted at an upper wall thereof, and a fuel temperature (TF) sensor 31 as a tank temperature detecting means mounted at a lateral wall thereof. The PT sensor 29, the FV sensor 30, and the TF sensor 31 are electrically connected to the ECU 5. The PT sensor 29 senses the pressure (tank internal pressure) PT within the fuel tank 23 and supplies an electrical signal indicative of the sensed tank internal pressure PT to the ECU 5. The FV sensor 30 senses the volumetric amount of fuel within the fuel tank 23 and supplies an electrical signal indicative of the sensed volumetric amount of fuel to the ECU 5. The TF sensor 31 senses the temperature of fuel within the fuel tank 23 and supplies an electrical signal indicative of the sensed fuel temperature TF to the ECU 5.

The first control valve 28 is comprised of a two-way valve 34 formed of a positive pressure valve 32 and a negative pressure valve 33, and a first electromagnetic valve 35 formed in one body with the two-way valve 34. More specifically, the first electromagnetic valve 35 has a rod **35*a*, a front end of which is fixed to a diaphragm 32*a* of the positive pressure valve 32. Further, the first electromagnetic valve 35 is electrically connected to the ECU 5 to have its operation controlled by a signal supplied from the ECU 5. When the first electromagnetic valve 35 is energized, the positive pressure valve 32 of the two-way valve 34 is forcedly opened to open the first control valve 28, whereas when the first electromagnetic valve 35 is deenergized, the valving (opening/closing) operation of the first control valve 28 is controlled by the two-way valve 34** alone.

A purge control valve (second control valve) 36 is arranged across the purging passage 10 extending from the canister 26, which valve has a solenoid, not shown, electrically connected to the ECU 5. The purge control valve 36 is controlled by a signal supplied from the ECU 5 to linearly change the opening thereof. That is, the ECU 5 supplies a desired amount of control current to the purge control valve 36 to control the opening thereof.

A hot wire-type flowmeter (mass flowmeter) 37 is arranged in the purging passage 10 at a location between the canister 26 and the purge control valve 36. The flowmeter 37 has a platinum wire, not shown, which is heated by an electric current and cooled by a gas flow flowing in the purging passage 10 to have its electrical resistance reduced. The flowmeter 37 has an output characteristic variable in dependence on the concentration and flow rate of evaporative fuel flowing in the purging passage 10 as well as on the flow rate of a mixture of evaporative fuel and air being purged through the purging passage 10. The flowmeter 37 is electrically connected to the ECU 5 for supplying the same with an electrical signal indicative of the flow rate of the mixture purged through the purging passage 10.

A drain shut valve 38 is mounted across the negative pressure communication passage 9 connecting between the air inlet port 25 of the canister 26 and the intake pipe 2, and a second electromagnetic valve 39 is mounted across the negative pressure communication passage 9 at a location downstream of the drain shut valve 38, the drain shut valve 38 and the second electromagnetic valve 39 constituting a third control valve 40.

The drain shut valve 38 has an air chamber 42 and a negative pressure chamber 43 defined by a diaphragm 41. Further, the air chamber 42 is formed of a first chamber 44 accommodating a valve element **44*a*, a second chamber 45 formed with an air introducing port 45*a*, and a narrowed communicating passage 47 connecting the second chamber 45 with the first chamber 44. The valve element 44*a* is connected via a rod 48 to the diaphragm 41. The negative pressure chamber 43 communicates with the second electromagnetic valve 39 via the communication passage 9, and has a spring 49 arranged therein for resiliently urging the diaphragm 41 and hence the valve element 44*a*** in the direction indicated by an arrow A.

The second electromagnetic valve 39 is constructed such that when a solenoid thereof is deenergized, a valve element thereof is in a seated position to allow air to be introduced into the negative pressure chamber 43 via an air inlet port 50, and when the solenoid is energized, the valve element is in a lifted position in which the negative pressure chamber 43 communicates with the intake pipe 2 via the communication passage 9. In addition, reference numeral 51 indicates a check valve.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, the first and second electromagnetic valves 35, 39, and the purge control valve 36.

Further, the ECU 5 (CPU) includes negatively pressurizing means which brings the evaporative emission control system 11 into a predetermined negatively pressurized state, and abnormality determining means which determines whether there is an abnormality in the evaporative emission control system 11, based upon an output from the PT sensor 29 which is generated when the system 11 has been brought into the predetermined negatively pressurized state by the negatively pressurizing means, when the vehicle is standing, when the interior of the fuel tank 23 is in a cold state, and/or when the volumetric amount of fuel within the fuel tank 232 falls within a predetermined range.

Figure 2:
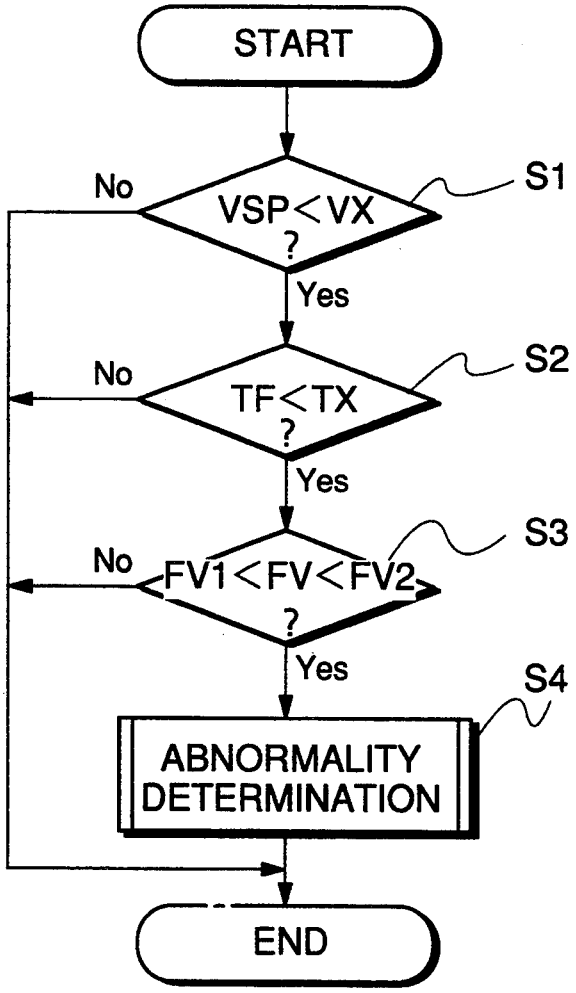
FIG. 2 is a flowchart showing a main program for carrying out determination of abnormality in an evaporative emission control system appearing in FIG. 1, according to the invention.

FIG. 2 shows a main program for determining an abnormality in the evaporative emission control system 11, according to the invention.

First, at a step S1, it is determined whether or not the vehicle speed VSP detected by the VSP sensor 18 is lower than a predetermined value VX (e.g. 2 km/hr). If the answer is negative (NO), the program is immediately terminated, without carrying out the abnormality determination, because when the vehicle is running, there can occur a large movement of the upper surface of fuel within the fuel tank 23 to cause a large change in the pressure PT and hence generation of a large amount of evaporative fuel within the fuel tank, particularly upon acceleration or deceleration, or upon turning of the vehicle.

On the other hand, if the answer to the question of the step S1 is affirmative (YES), it is determined that the vehicle is standing or in stoppage, and then the program proceeds to a step S2 wherein it is determined whether or not the fuel temperature TF detected by the TF sensor 31 is lower than a predetermined value (e.g. 25° C.). In this embodiment, the output from the TF sensor 31 is used to determine whether or not the interior of the fuel tank 23 is in a cold state. If the answer to the question of the step S2 is negative (NO), it is presumed that the interior of the fuel tank 23 is still in a hot state such as immediately after stoppage of the vehicle and therefore there exists a large amount of evaporative fuel generated within the fuel tank 23. Therefore, the program is immediately terminated without carrying out the abnormality determination.

On the other hand, if the answer to the question of the step S2 is affirmative (YES), it is determined that the interior of the fuel tank 23 is in a cold state, and then it is determined at a step S3 whether or not the volumetric amount of fuel FV detected by the FV sensor 30 falls within a predetermined range defined by a lower limit value FV1 which corresponds, e.g. to one third of the maximum volumetric amount assumed when the fuel tank 23 is fully filled with fuel and a higher limit value FV2 which corresponds, e.g. to two thirds of the same. This predetermined range is set to a range within which there cannot occur such a large amount of evaporative fuel generated within the fuel tank 23 as to make it impossible to carry out accurate abnormality determination. If the answer to this question is negative (NO), the program is immediately terminated without carrying out the abnormality determination, whereas if the answer is affirmative (YES), the program proceeds to a step S4 to carry out the abnormality determination, followed by terminating the program.

Although in the present embodiment, whether or not the interior of the fuel tank 23 is in a cold state is determined by the use of the TF sensor 31, alternatively it may be determined by estimating the temperature within the fuel tank 23 from an output value from the TA sensor 14, the TW sensor 15, or a like sensor for sensing a temperature of the engine, or from a combination of output values from these sensors.

Further, although in the present embodiment the abnormality determination is permitted to be carried out only when all the conditions determined by the vehicle speed VSP, the temperature within the fuel tank 23, and the amount of fuel within the fuel tank 23 are fulfilled, alternatively it may be permitted to be carried out when only one of the conditions, for example, the vehicle speed VSP, is fulfilled, or it may be permitted to be carried out depending upon fulfillment of two of the conditions such as the vehicle speed VSP and the temperature within the fuel tank 23.

Moreover, although in the embodiment the amount of evaporative fuel generated within the fuel tank 23 is estimated from the volumetric fuel amount FV within the fuel tank 23, alternatively a predetermined value (e.g. P3 in FIG. 10), hereinafter referred to, which is used for the abnormality determination may be altered depending upon the detected fuel amount FV.

Next, the manner of the abnormality determination carried out at the step S4 in FIG. 2 will be described in detail with reference to FIG. 3.

Figure 3:
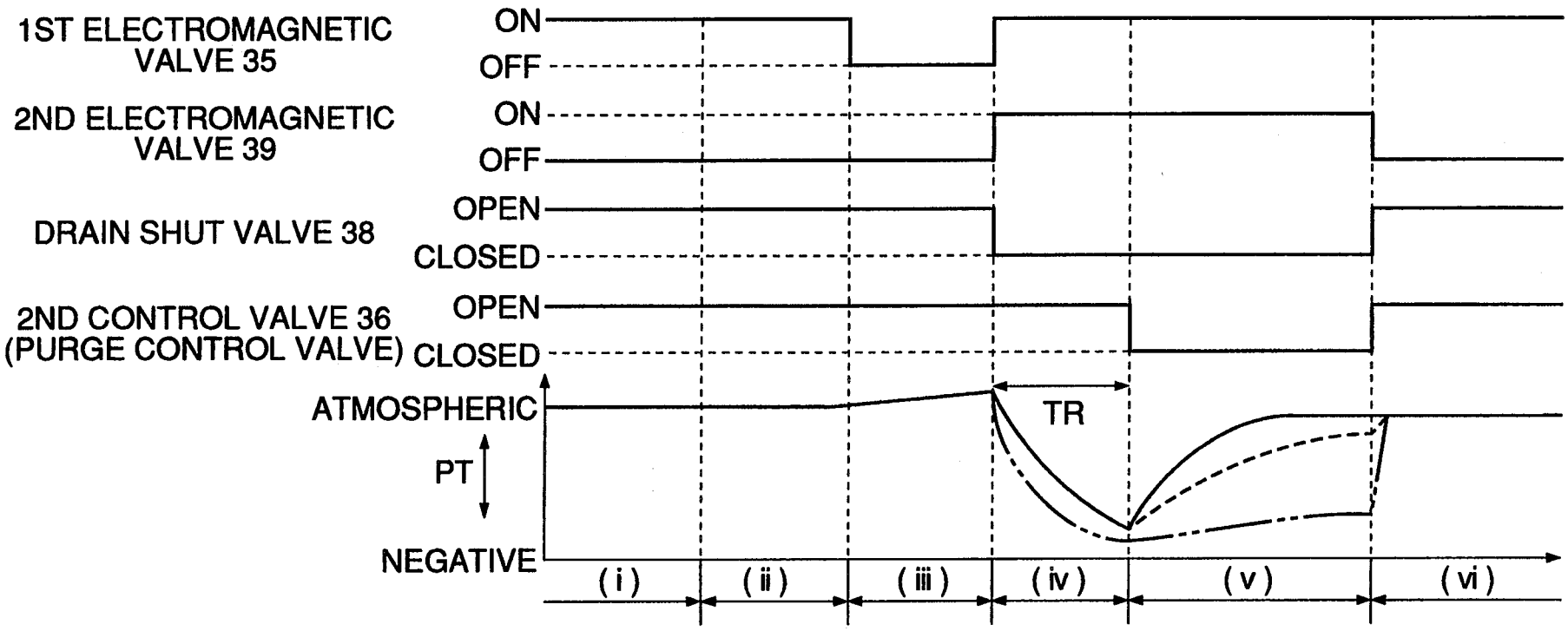
FIG. 3 is a timing chart showing operating patterns of first and second electromagnetic valves and a drain shut valve, all appearing in FIG. 1.

FIG. 3 shows patterns of operations of the first and second electromagnetic valves 35, 39 and the drain shut valve 38 and the purge control valve 36 performed during an diagnosis of abnormality of the evaporative emission control system 11, and changes in the tank internal pressure PT occurring during the diagnosis. The operations of these valves are commanded by control signals from the ECU 5.

First, during normal operation (normal purging) of the engine, as indicated by (i) in FIG. 3, the first electromagnetic valve 35 is energized and at the same time the second magnetic valve 39 is deenergized. When the ignition switch IGSW is closed and the engine is detected to be operating, by the IGSW sensor 18, the purge control valve 36 is energized to be opened. Then, evaporative fuel generated within the fuel tank 23 is allowed to flow through the evaporative fuel-guiding passage 27 into the canister 26 to be temporarily adsorbed by the adsorbent 24. Since the second electromagnetic valve 39 is deenergized as mentioned above, the drain shut valve 38 is open to allow fresh air to be introduced into the canister 26 through the air inlet port **45*a* so that evaporative fuel flowing into and stored in the canister 26 is purged together with fresh air through the second control valve 36 into the purging passage 10. On this occasion, if the fuel tank 23 is cooled due to ambient air, etc., negative pressure is developed within the fuel tank 23, which causes the negative pressure valve 33 of the two-way valve 34 to be opened so that part of the evaporative fuel in the canister 26 is returned through the two-way valve 34 into the fuel tank 23**.

When predetermined abnormality determining conditions, hereinafter described, are satisfied, the first and second electromagnetic valves 35, 39, and the purge control valve 36 are operated in the following manner to carry out an abnormality diagnosis of the evaporative emission control system 11.

First, the tank internal pressure PT is relieved to the atmosphere, over a time period indicated by (ii) in FIG. 3. More specifically, the first electromagnetic valve 35 is held in the energized state to maintain communication between the fuel tank 23 and the canister 26, and at the same time the second electromagnetic valve 39 is held in the deenergized state to keep the drain shut valve 38 open. Further, the purge control valve 36 is held in the energized state or opened, to relieve the tank internal pressure PT to the atmosphere.

Then, an amount of change in the tank internal pressure PT is measured over a time period indicated by (iii) in FIG. 3.

More specifically, the second electromagnetic valve 39 is held in the deenergized state to keep the drain shut valve 38 open, and at the same time the purge control valve 36 is kept open. However, the first electromagnetic valve 35 is turned off into the deenergized state, to thereby measure an amount of change in the tank internal pressure PT occurring after the fuel tank 23 has ceased to be open to the atmosphere for the purpose of checking an amount of evaporative fuel generated in the fuel tank 23.

Then, the evaporative emission control system 11 is negatively pressurized over a time period TR indicated by (iv) in FIG. 3. More specifically, the first electromagnetic valve 35 and the purge control valve 36 are held in the energized state, while the second electromagnetic valve 39 is turned on to close the drain shut valve 38, whereby the evaporative emission control system 11 is negatively pressurized by a gas drawing force developed by negative pressure in the purging passage 10 held in communication with the intake pipe 2.

Then, a leak down check is carried out over a time period indicated by (v) in FIG. 3.

More specifically, after the evaporative emission control system 11 is negatively pressurized to a predetermined degree, i.e. after the predetermined negatively-pressurized condition of the system is established, the purge control valve 36 is closed, and then a change in the tank internal pressure PT occurring with the lapse of time thereafter is checked by the PT sensor 29. If the system 11 does not suffer from a significant leak of evaporative fuel therefrom, and hence the result of the leak down check shows that there is no substantial change in the tank internal pressure PT as indicated by the two-dot-chain line in the figure, it is determined that the evaporative emission control system 11 is normal, whereas if the system 11 suffers from a significant leak of evaporative fuel therefrom, and hence the result of the leak down check shows that there is a significant change in the tank internal pressure PT toward the atmospheric pressure, the tank internal pressure PT should change in the following manner:

When the amount of fuel within the fuel tank 23 is relatively large, the tank internal pressure PT changes as indicated by the solid line, while when the fuel amount is relatively small, the tank internal pressure PT changes as indicated by the broken line. Then, it is determined that the system 11 is abnormal. In this connection, if the evaporative emission control system 11 cannot be brought into the predetermined negatively pressurized state within a predetermined time period, the leak down check is inhibited, as hereinafter described.

After determining whether or not the system 11 is abnormal, the system 11 returns to the normal purging mode, as indicated by (vi) in FIG. 3.

More specifically, while the first electromagnetic valve 35 is held in the energized state, the second electromagnetic valve 39 is deenergized and the purge control valve 36 is opened, to thereby perform normal purging of evaporative fuel. In this state, the tank internal pressure PT is relieved to the atmosphere and hence becomes substantially equal to the atmospheric pressure.

Next, the manner of abnormality diagnosis of the evaporative emission control system 11 will be described.

FIG. 4 shows a program for carrying out the abnormality diagnosis of the evaporative emission control system 11, which is executed by the CPU of the ECU 5.

First, at a step S11, a routine of determining permission for monitoring (determination of fulfillment of abnormality determining conditions) is carried out, as described hereinafter. Then, at a step S12, it is determined whether or not the monitoring of the system 11 for abnormality diagnosis is permitted, i.e. a flag FMON is set to "1". If the answer to this question is negative (NO), the first to third control valves 28, 36, 40 are set to respective operative states for normal purging mode of the system as mentioned before, followed by terminating the program, whereas if the answer to this question is affirmative (YES), the tank internal pressure PT in the open-to-atmosphere condition of the system is checked at a step S13, and it is determined at a step S14 whether or not this check has been completed. If the answer to this question is negative (NO), the program is immediately terminated, whereas if it is affirmative (YES), the first electromagnetic valve 35 is turned off to check a change in the tank internal pressure PT at a step S15, followed by determining at a step S16 whether or not this check has been completed. If the answer to this question is negative (NO), the program is immediately terminated, whereas if it is affirmative (YES), the first to third control valves 28, 36, 40 are operated at a step S17 to bring about the negatively pressurized state of the evaporative emission control system 11 and the fuel tank 23.

Simultaneously with the start of the negative pressurization at the step S17, a first timer tmPRG incorporated in the ECU 5 is started, and it is determined at a step S18 whether or not the count value thereof is larger than a value corresponding to a predetermined time period T1. The predetermined time period T1 is set to such a value as to ensure that the system 11 is negatively pressurized to a predetermined pressure value, i.e. the negatively pressurized condition of the system 11 is established within the predetermined time period T1, if the system is normal. If the answer to the question of the step S18 is affirmative (YES), it is determined that the system 11 cannot be negatively pressurized to the predetermined pressure value due to a hole formed in the fuel tank 23, etc., the program proceeds to a step S22. On the other hand, if the answer to the question of the step S18 is negative (NO), it is determined at a step S19 whether or not the negative pressurization has been completed, i.e. the negatively pressurized state of the system 11 is established. If the answer to this question is negative (NO), the program is immediately terminated, whereas if it is affirmative (YES), a leak down check routine, described in detail hereinafter, is carried out at a step S20 to check whether or not the system 11 is properly sealed, i.e. it is free from a leak of evaporative fuel therefrom in the normal operating mode thereof. Then, at a step S21, it is determined whether or not this check has been completed.

If the answer to this question is negative (NO), the program is immediately terminated, whereas if the answer is affirmative (YES), the program proceeds to the step S22.

At the step S22, a determination is made as to whether or not the system 11 is in a normal condition, followed by determining at a step S23 whether the determination of the step S22 has been completed. If the answer to this question is negative (NO), the program is immediately terminated, whereas if it is affirmative (YES), the system 11 is set to the normal purging mode at a step S24, followed by terminating the program.

Next, the above steps will be described in detail hereinbelow:

(1) Determination of Permission for Monitoring (at the step S11 in FIG. 4)

Figure 5:
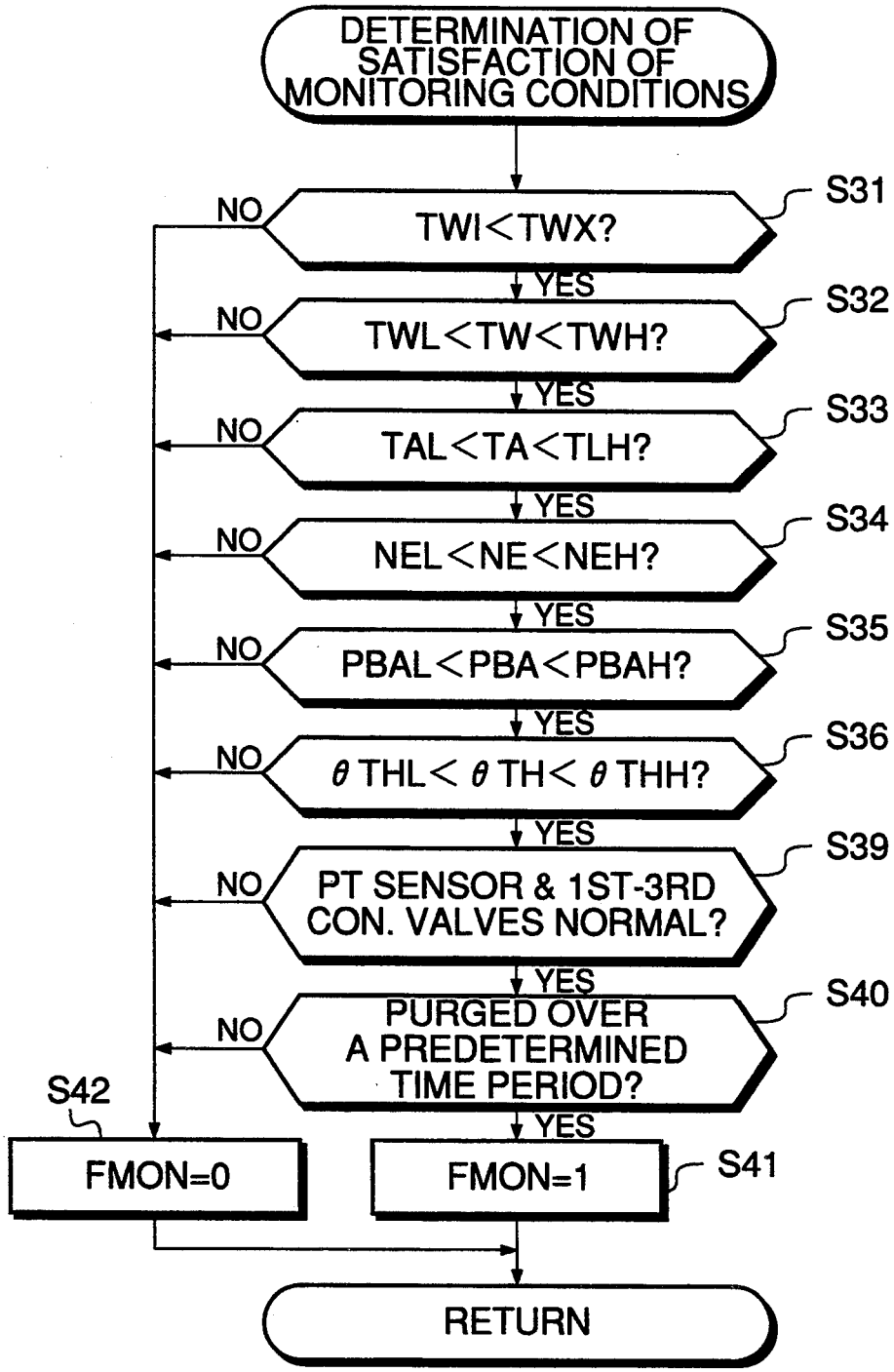
FIG. 5 is a flowchart showing a routine for determining fulfillment of abnormality determining conditions.

FIG. 5 shows a routine for determining whether or not monitoring of the system 11 for abnormality diagnosis thereof is permitted. This routine is executed as a background processing.

At a step S31, it is determined whether or not the engine coolant temperature TW detected at the start of the engine 1 is lower than a predetermined value TWX. The abnormality diagnosis of the present embodiment has only to be carried out only after the engine has been out of operation for a long time period (e.g. once per day). First, when the ignition switch IGSW is closed, the engine coolant temperature TW is detected at the start of the engine and read in, and it is determined at the step S31 in the present routine whether or not the engine coolant temperature TW is lower than the predetermined value TWX, e.g. 20° C. If the answer to this question is affirmative (YES), i.e. if the engine coolant temperature TW detected at the start of the engine is lower than the predetermined value TWX, the program proceeds to a step S32, wherein it is determined whether or not the engine coolant temperature TW detected by the TW sensor 15 falls between a predetermined lower limit value TWL (e.g. 50° C.) and a predetermined upper limit value TWH (e.g. 90° C.). If the answer to this question is affirmative (YES), it is determined at a step S33 whether or not the intake air temperature TA detected by the TA sensor 14 falls between a predetermined lower limit value TAL (e.g. 70° C.) and a predetermined upper limit value TAH (e.g. 90° C.). If the answer to this question is affirmative (YES), it is determined that the engine 1 has been warmed up, and then the program proceeds to a step S34.

At the step S34, it is determined whether or not the engine rotational speed NE detected by the NE sensor 16 falls between a predetermined lower limit value NEL (e.g. 2000 rpm) and a predetermined upper limit value NEH (e.g. 4000 rpm). If the answer to this question is affirmative (YES), it is determined at a step S35 whether or not the intake pipe absolute pressure PBA detected by the PBA sensor 13 falls between a predetermined lower limit value PBAL (e.g. a negative value of −350 mmHg) and a predetermined upper limit value PBAH (e.g. a negative value of −150 mmHg). If the answer to this question is affirmative (YES), it is determined at a step S36 whether or not the throttle valve opening θTH detected by the θTH sensor 4 falls between a predetermined lower limit value θTHL (e.g. 1°) and a predetermined upper limit value θTHH (e.g. 5°). If the answer to this question is affirmative (YES), it is determined at a step S39 whether or not the PT sensor 29, and the first to third control valves 28, 36, and 39 are normally operating. If the answer to this question is affirmative (YES), it is determined at a step S40 whether or not purging of evaporative fuel has been carried out over a predetermined time period. More specifically, in the case where a large amount of evaporative fuel is stored in the canister 26, it takes a longer time period to establish the negatively pressurized condition of the system 11 due to the resulting large resistance of the canister 26 to permeation of gases, or there is a fear that undesirably rich evaporative fuel is purged into the intake system during the negative pressurization. Therefore, in the present embodiment, monitoring of the evaporative emission control system 11 is carried out only after the purging of evaporative fuel has been carried over the predetermined time period, to reduce the amount of evaporative fuel adsorbed and stored in the canister 26.

If the answer to the question of the step S40 is affirmative (YES), the flag FMON is set to "1" at a step S41 for permitting monitoring of the system 11 for abnormality diagnosis, followed by terminating the program. On the other hand, if at least one of the answers to the questions of the steps S31 to S40 is negative (NO), the conditions for permitting monitoring are not satisfied, so that the flag FMON is set to "0" at a step S42, followed by terminating the program.

(2) Check of Tank Internal Pressure in Open-to-Atmosphere Condition (at the step S13 in FIG. 4)

Figure 6:
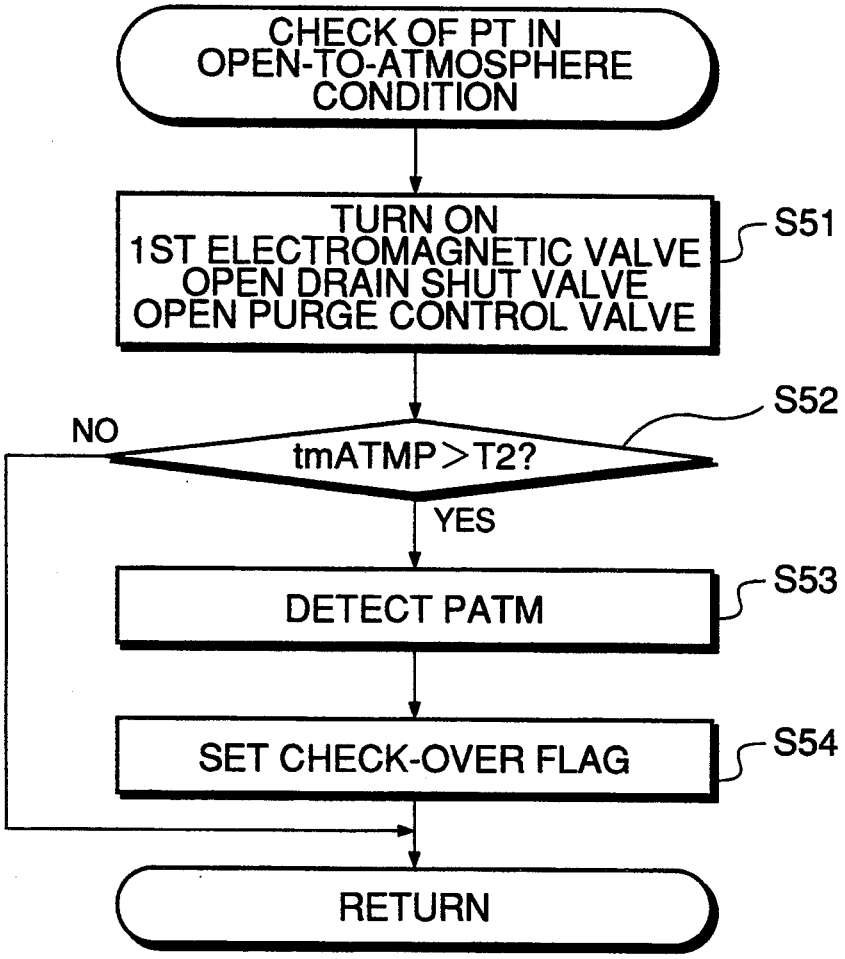
FIG. 6 is a flowchart showing a routine for checking changes in the tank internal pressure when the interior of the evaporative emission control system is made open to the atmosphere.

FIG. 6 shows a routine for carrying out the tank internal pressure check in the open-to-atmosphere condition, which is also executed as a background processing.

First, at a step S51, the system 11 is set to the open-to-atmosphere mode, and at the same time, a second timer tmATMP is reset and started. More specifically, the first electromagnetic valve 35 is held in the energized state, and at the same time the second electromagnetic valve 39 is held in the deenergized state to keep the drain shut valve 38 open. Further, the purge control valve 36 is kept open. Thus, the tank internal pressure PT is relieved to the atmosphere (see the time period indicated by (ii) in FIG. 3).

Then, at a step S52, it is determined whether or not the count value of the second timer tmATMP is larger than a value corresponding to a predetermined time period T2. The predetermined time period T2 is set to a predetermined value, e.g. 4 sec, which ensures that the pressure within the system 11 has been stabilized upon lapse thereof. If the answer to this question is negative (NO), the program is immediately terminated, while if it is affirmative (YES), the program proceeds to a step S53, where the tank internal pressure PATM in the open-to-atmosphere condition is detected by the PT sensor 29 and stored into the ECU 5, and then a check-over flag is set at a step S54, followed by terminating the program.

(3) Check of A Change in Tank Internal Pressure (at the step S15 in FIG. 4)

Figure 7:
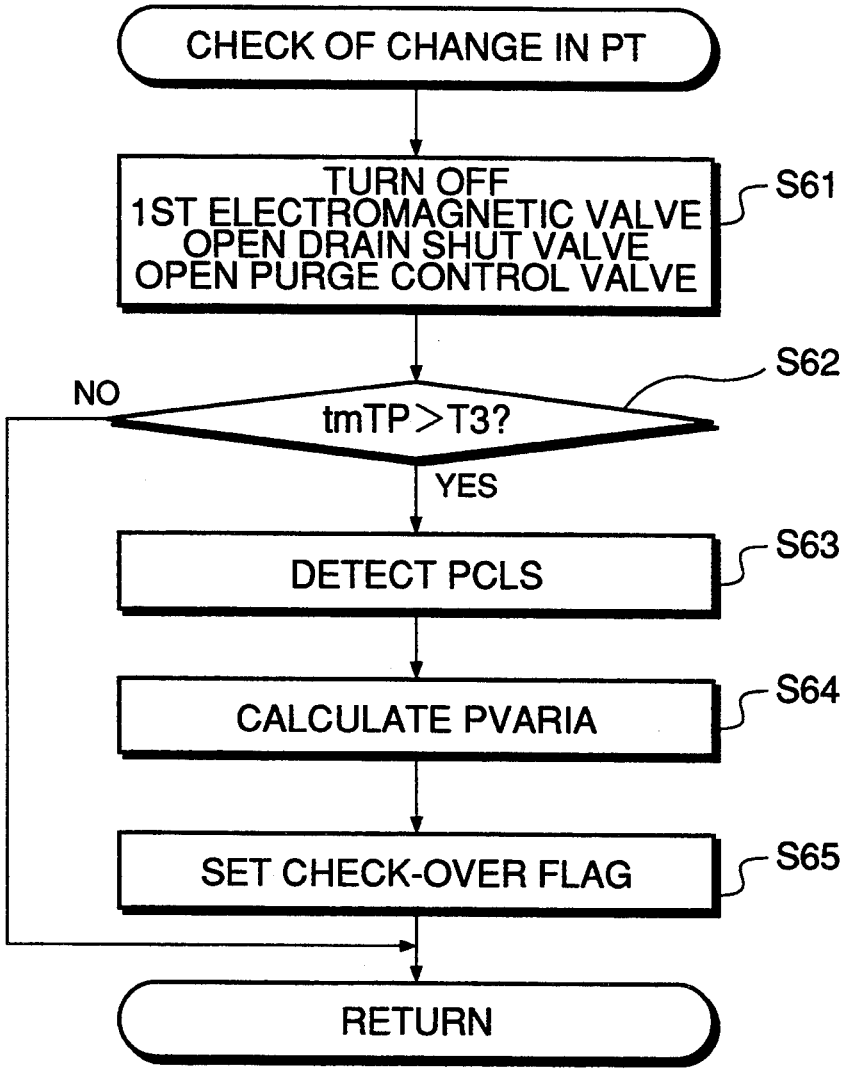
FIG. 7 is a flowchart showing a routine for checking a change in the tank internal pressure.

FIG. 7 shows a routine for checking a change in the tank internal pressure, which is executed as a background processing.

First, at a step S61, the system 11 is set to a PT change-checking mode, and at the same time a third timer tmTP is reset and started. More specifically, while the purge control valve 36 and the drain shut valve 38 are held open, the first electromagnetic valve 35 is turned off to thereby set the system to the PT change checking mode (see the time period indicated by (iii) in FIG. 3).

Then, at a step S62, it is determined whether or not the count value of the third timer tmTP is larger than a value corresponding to a third predetermined time period T3, e.g. 10 sec. If the answer to this question is negative (NO), the program is immediately terminated, whereas if it is affirmative (YES), the tank internal pressure PCLS after the lapse of the predetermined time period T3 is detected and stored into the ECU 5 at a step S63, followed by calculation of a first rate of change PVARIA in the tank internal pressure at a step S64 by the use of the following equation (1):

$$PVARIA=(PCLS-PATM)/T3 \quad (1)$$

Then, the first rate of change PVARIA thus calculated is stored into the ECU 5 and a check-over flag is set at a step S65, followed by terminating the program.

(4) Negative Pressurization (at the step S17 in FIG. 4 )

Figure 8:
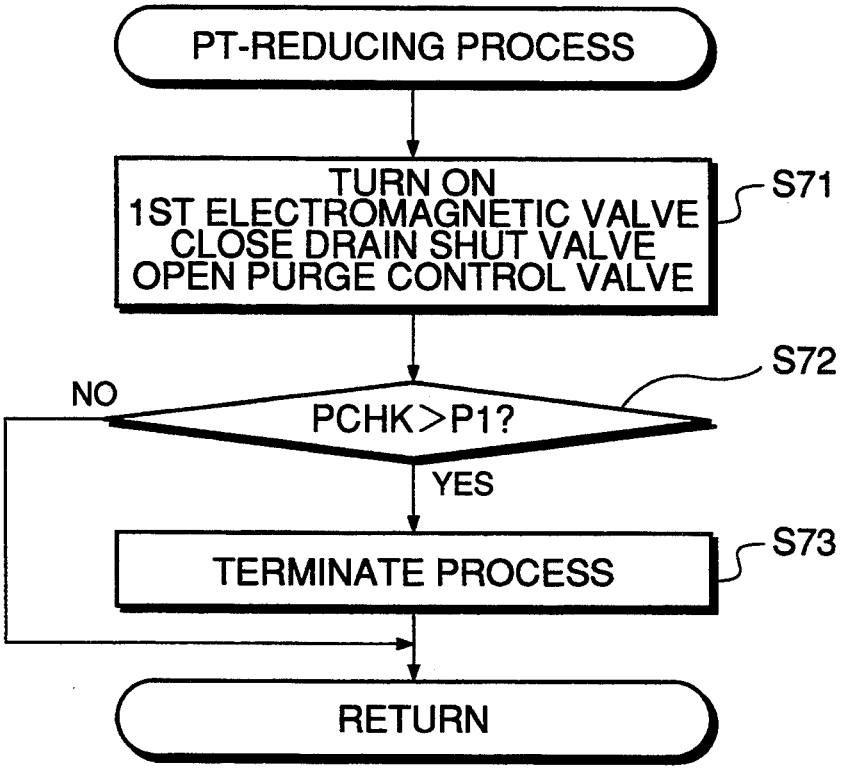
FIG. 8 is a flowchart showing a routine for reducing the tank internal pressure.

FIG. 8 shows a routine for carrying out a process of negatively pressurizing the system 11 to establish the negatively pressurized state of the system, which is executed as a background processing.

First, at a step S71, the system 11 is set to a negatively-pressurizing mode. More specifically, the purge control valve 36 is kept open, and at the same time the first electromagnetic valve 35 is turned on, and the second electromagnetic valve 39 is turned on to close the drain shut valve 38 (see the time period indicated by (iv) in FIG. 3). In this state, the system 11 is negatively pressurized to a predetermined value by a gas-drawing force created by operation of the engine 1. Then, it is determined at a step S72 whether or not the tank internal pressure PCHK in this mode of the system 11 is lower than a predetermined value P1 (e.g. −20 mmHg). If the answer to this question is negative (NO), the program is immediately terminated, whereas if it becomes affirmative (YES), a process-over flag is set at a step S73, followed by terminating the program.

(5) Leak Down Check (at the step S20 in FIG. 4)

Figure 9:
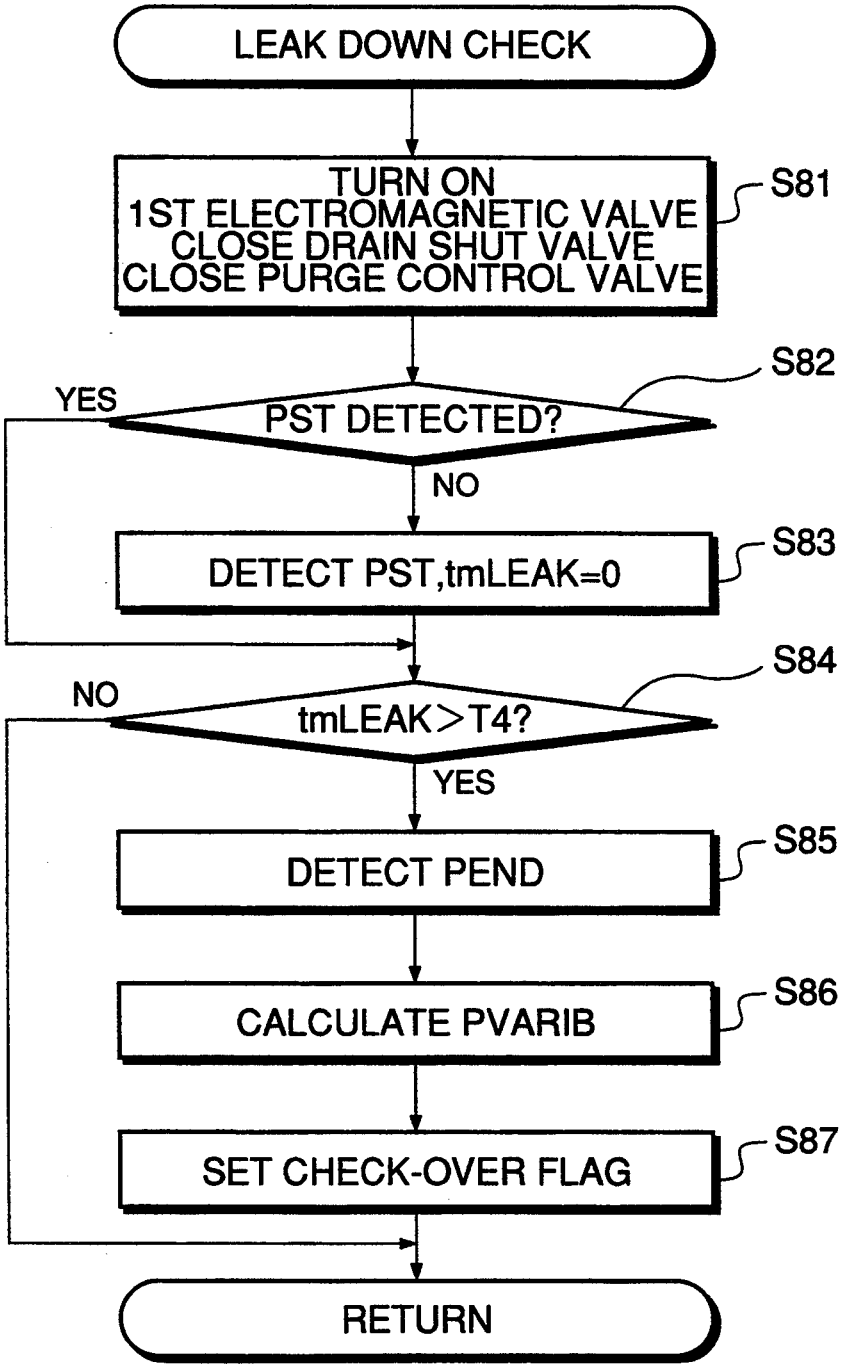
FIG. 9 is a flowchart showing a leak down check routine for checking a change rate in the tank internal pressure when the evaporative emission control system is isolated from the intake pipe.

FIG. 9 shows a routine for performing a leak down check of the system 11, which is executed as a background processing.

First, at a step S81, the system 11 is set to a leak down check mode. More specifically, while the first electromagnetic valve 35 is held in the energized state, and at the same time the drain shut valve 38 is kept closed, the purge control valve 36 is closed to cut off the communication between the system 11 and the intake pipe 2 of the engine 1 (see the time period (v) in FIG. 3 ) .

Then, the program proceeds to a step S82, wherein it is determined whether or not the tank internal pressure PST at the start of the leak down check has been detected. In the first execution of this step S82, the answer to this question is negative (NO), so that the program proceeds to a step S83, wherein the tank internal pressure PST is detected and a fourth timer tmLEAK is reset and started.

Then, it is determined at a step S84 whether or not the count value of the fourth timer tmLEAK is larger than a value corresponding to a fourth predetermined time period T4 (e.g. 10 sec.). In the first execution of this step S84, the answer to this question is negative (NO), so that the program is immediately terminated.

In the following loop, the answer to the question of the step S82 becomes affirmative (YES), so that the program jumps over to the step S84, wherein it is determined whether or not the count value of the fourth timer tmLEAK is larger than the value corresponding to the predetermined time period T4. If the answer to this question is negative (NO), the program is immediately terminated, whereas if it becomes affirmative (YES), the present tank internal pressure i.e. the tank internal pressure PEND at the end of the leak down check is detected and stored into the memory means of the ECU 5 at a step S85, followed by calculation of a second rate of change PVARIB in the tank internal pressure PT at a step S86 by the use of the following equation (2):

$$PVARIB=(PEND-PST)/T4 \quad (2)$$

The second rate of change PVARIB in the tank internal pressure PT thus calculated is stored into the memory means of the ECU 5, and a check-over flag is set at a step S87, followed by terminating the program.

(6) System Condition-Determining Process (at the step S22 in FIG. 4)

Figure 10:
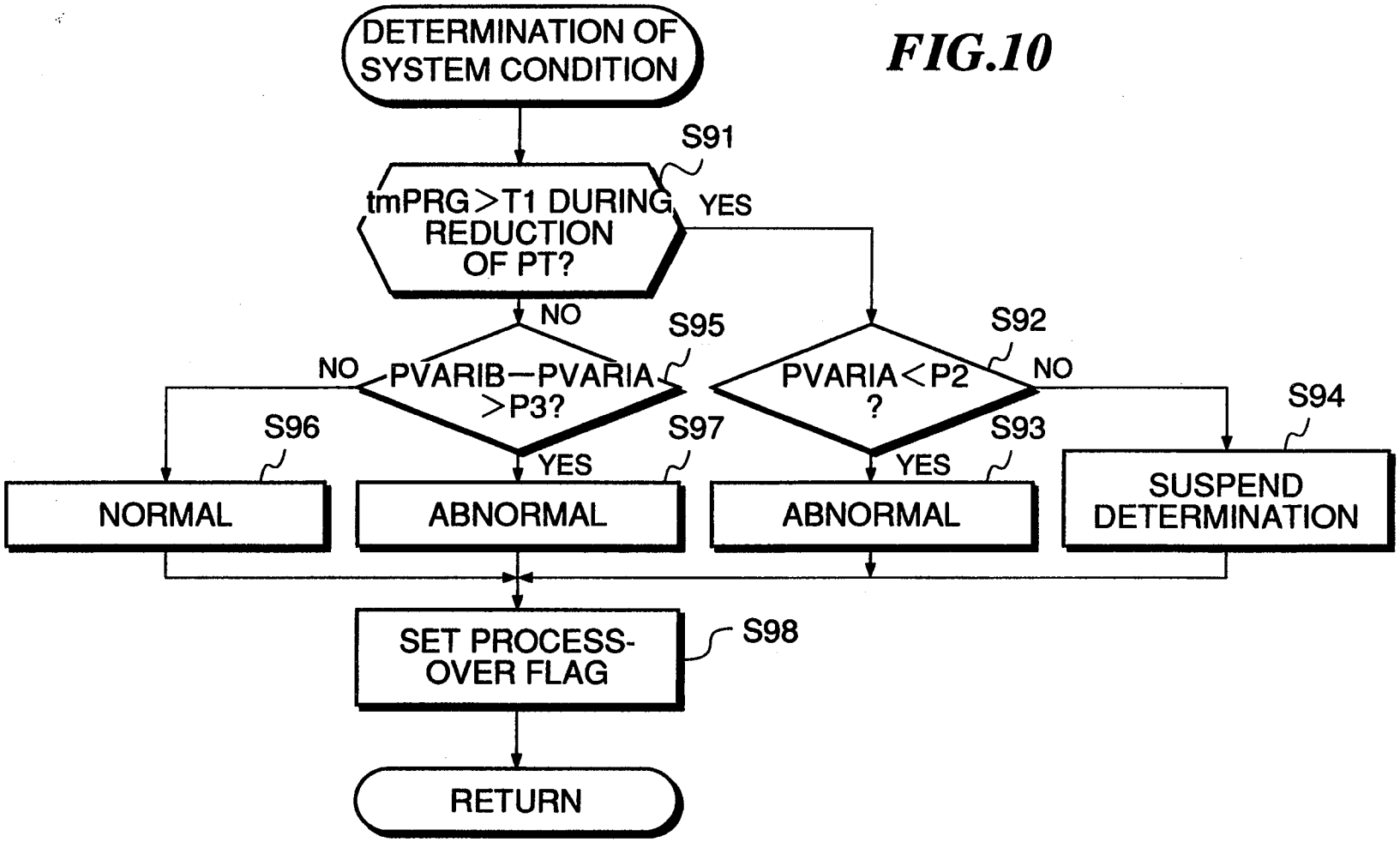
FIG. 10 is a flowchart showing a routine for determining a condition of the evaporative emission control system.

FIG. 10 shows a routine for carrying out a process of determining a condition of the system 11, which is executed as a background processing.

First, at a step S91, it is determined whether or not the count value of the first timer tmPRG exceeded the value corresponding to the predetermined value T1 during the negatively-pressurizing process. If the answer to this question is affirmative (YES), it is determined that the system 11 may suffer from a significant leak of evaporative fuel due to a hole formed in the fuel tank 23, etc., so that the program proceeds to a step S92, where it is determined whether or not the first rate of change PVARIA in the tank internal pressure PT is smaller than a predetermined value P2. If the answer to this question is affirmative (YES), which means that the rate of rise in the tank internal pressure PT was low during the check of a change in the tank internal pressure PT at (iii) in FIG. 3, it is determined that the system 11 suffers from a significant leak of evaporative fuel from the fuel tank 23, piping connections, etc., determining that the evaporative emission control system 11 is abnormal (step S93), and then a process-over flag is set at a step S98, followed by terminating the program. On the other hand, if the answer to the question of the step S92 is negative (NO), which means that evaporative fuel was generated in a large amount in the fuel tank 23 to increase the tank internal pressure PT, which prevented the system 11 from being negatively pressurized in a proper manner in the negatively-pressurizing process, the determination of the system condition is suspended at a step S94, and then the process-over flag is set at the step S98, followed by terminating the program.

Figure 11:
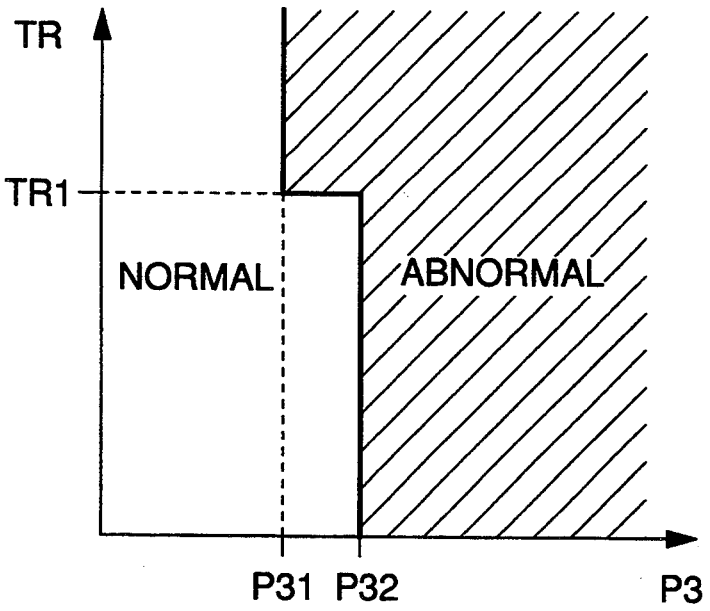
FIG. 11 shows a map used for the abnormality determination.

On the other hand, if the answer to the question of the step S91 is negative (NO), i.e. if the system 11 was negatively pressurized to the predetermined value within the predetermined time period tmPRG, an abnormality-determining routine is carried out at a step S95, wherein it is determined whether or not the difference between the second rate of change PVARIB and the first rate of change PVARIA is larger than a predetermined value P3, in order to determine whether the value of the second rate of change PVARIB is due to a leak from the evaporative emission control system 11 or due to the amount of evaporative fuel generated within the fuel tank 23. The predetermined value P3 is set depending upon the negatively pressuring time period TR as shown in FIG. 11. More specifically, it is set to a value P31 when the time period TR is longer than a predetermined value TR1, while it is set to a value P32 (>P31) when the former is shorter than the latter. If the answer to the question of the step S95 is negative (NO), it is determined that the system 11 is normal, followed by terminating the program, whereas if the answer is affirmative (YES), it is determined at a step S97 that the second rate of change PVARIB assumes a large value because there has been occurring a large leak amount from the system 11, and hence it is determined that the system 11 is abnormal, followed by terminating amount.

If the predetermined value P3 is changed depending upon the detected fuel amount FV within the fuel tank 23 as mentioned before, the value P3 is set in the following manner: If the fuel amount within the fuel tank is larger than a predetermined value and accordingly the volume of a fuel vapor layer formed within the fuel tank 23 is small, the value P3 is set to a larger value than a value to which it is set when the fuel amount is smaller than the predetermined value and accordingly the volume of the fuel vapor layer is large, thereby enabling to carry out the leak down check of the system 11 in a proper manner depending upon the amount of evaporative fuel generated within the fuel tank 23.

(7) Normal Purging (at the step S24 in FIG. 4)

Figure 12:
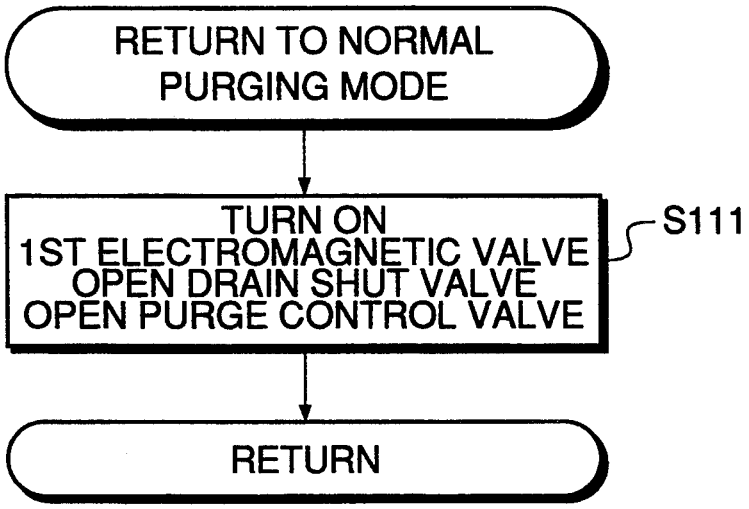
FIG. 12 is a flowchart showing a routine for carrying out normal purging.

FIG. 12 shows a routine for restoring the normal purging mode of the system 11, in which the operative states of the valves are specified.

More specifically, the first electromagnetic valve 35 is held in the energized state and the drain shut valve 39 and the purge control valve 36 are opened to thereby set the system to the normal purging mode, at a step S111, followed by terminating the program.

What is claimed is:

1. In an evaporative fuel-processing system for an internal combustion engine installed in a vehicle and having an intake system, and a fuel tank, the system includes an evaporative emission control system including, said fuel tank, a canister having an air inlet port provided therein, an evaporative fuel-guiding passage extending between said fuel tank and said canister, a first control valve arranged across said evaporative fuel-guiding passage, a purging passage extending between said canister and said intake system of said engine, and a second control valve arranged across said purging passage, the improvement comprising:

pressure detecting means for detecting pressure within said evaporative emission control system;

negatively pressurizing means including a third control valve arranged at said air inlet port of said canister, said negatively pressurizing means for bringing said evaporative emission control system into a predetermined negatively pressurized state by closing said third control valve;

parameter detecting means for detecting a value of at least one of a parameter representative of a running condition of said vehicle and at least one parameter representative of an internal state of said fuel tank, said parameters affecting pressure within said evaporative emission control system and generation of evaporative fuel within said fuel tank; and abnormality determining means responsive to an output from said parameter detecting means, for determining whether there is an abnormality in said evaporative emission control system, based upon an output from said pressure detecting means, which is obtained when said evaporative emission control system has been brought into said predetermined negatively pressurized state, when said value of said at least one of said parameters detected by said parameter detecting means falls within a predetermined range.

2. An evaporative fuel-processing system as claimed in claim 1, wherein said parameter representative of said running condition of said vehicle includes traveling speed of said vehicle.

3. An evaporative fuel-processing system as claimed in claim 1, wherein said at least one parameter representative of said internal state of said fuel tank includes temperature within said fuel tank.

4. An evaporative fuel-processing system as claimed in claim 1, wherein at least one parameter representative of said internal state of said fuel tank includes an amount of fuel within said fuel tank.

5. An evaporative fuel-processing system as claimed in claim 1, including engine operation detecting means for detecting whether said engine is operating, and a third control valve for opening and closing said air inlet port of said canister, and wherein said negatively pressurizing means brings said evaporative emission control system into said predetermined negatively pressurized state by controlling said first to third control valves while said engine is detected to be operating.

6. An evaporative fuel-processing system as claimed in claim 1, wherein said abnormality determining means determines whether there is an abnormality in said evaporative emission control system, based upon a rate of change in said pressure within said fuel tank occurring with the lapse of time after said evaporative emission control system has been brought into said predetermined negatively pressurized state by said negatively pressurizing means.

7. An evaporative fuel-processing system as claimed in claim 6, wherein said abnormality determining means compares said rate of change in said pressure within said fuel tank with a predetermined value which is set depending upon an amount of fuel within said fuel tank, and determines whether or not said evaporative emission control system is abnormal, based upon a result of said comparison.

8. In an evaporative fuel-processing system for an internal combustion engine installed in a vehicle and having an intake system, and a fuel tank, the system includes an evaporative emission control system including a canister having an air inlet port provided therein, an evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

negatively pressurizing means for bringing said evaporative emission control system into a predetermined negatively pressurized state;

vehicle speed detecting means for detecting traveling speed of said vehicle; and abnormality determining means responsive to an output from said vehicle speed detecting means, for determining whether there is an abnormality in said evaporative emission control system, based upon an output from said tank internal pressure detecting means, which is obtained when said evaporative emission control system has been brought into said predetermined negatively pressurized state, when it is detected from an output from said vehicle speed detecting means that said vehicle is standing.

9. In an evaporative fuel-processing system for an internal combustion engine installed in a vehicle and having an intake system, and a fuel tank, the system includes an evaporative emission control system including a canister having an air inlet port provided therein, and evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

negatively pressurizing means for bringing said evaporative emission control system into a predetermined negatively pressurized state;

tank temperature detecting means for detecting temperature within said fuel tank; and abnormality determining means responsive to an output from said tank temperature detecting means, for determining whether there is an abnormality in said evaporative emission control system, based upon an output from said tank internal pressure detecting means, which is obtained when said evaporative emission control system has been brought into said predetermined negatively pressurized state, when it is detected from an output from said tank temperature detecting means that an interior of said fuel tank is in a predetermined cold state.

10. In an evaporative fuel-processing system for an internal combustion engine installed in a vehicle and having an intake system, and a fuel tank, the system includes an evaporative emission control system including, said fuel tank, a canister having an air inlet port provided therein, an evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

pressure detecting means for detecting pressure within said evaporative emission control system;

negatively pressurizing means including a third control valve arranged at said air inlet port of said canister, said negatively pressurizing means for bringing said evaporative emission control system into a predetermined negatively pressurized state by closing said third control valve;

fuel amount detecting means for detecting an amount of fuel within said fuel tank; and abnormality determining means responsive to an output from said fuel amount detecting means, for determining whether there is an abnormality in said evaporative emission control system, based upon an output from said pressure detecting means, which is obtained when said evaporative emission control system has been brought into said predetermined negatively pressurized state, when it is detected from an output from said fuel amount detecting means that said amount of fuel within said fuel tank falls within a predetermined range.

11. In an evaporative fuel-processing system for an internal combustion engine installed in a vehicle and having an intake system, and a fuel tank, the system includes an evaporative emission control system including a canister having an air inlet port provided therein, an evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

negatively pressurizing means for bringing said evaporative emission control system into a predetermined negatively pressurized state;

vehicle speed detecting means for detecting traveling speed of said vehicle;

tank temperature detecting means for detecting temperature within said fuel tank;

fuel amount detecting means for detecting an amount of fuel within said fuel tank; and abnormality determining means responsive to an output from said detecting means, for determining whether there is an abnormality in said evaporative emission control system, based upon an output from said tank internal pressure detecting means, which is obtained when said evaporative emission control system has been brought into said predetermined negatively pressurized state, when it is detected from an output from at least one of said vehicle speed detecting means, said tank temperature detecting means, and said fuel amount detecting means that at least one of the following conditions is fulfilled:

said vehicle is standing;

an interior of said fuel tank is in a predetermined cold state; and said amount of fuel within said fuel tank falls within a predetermined range.

12. In an evaporative fuel-processing system for an internal combustion engine installed in a vehicle and having an intake system, and a fuel tank, the system includes an evaporative emission control system including a canister having an air inlet port provided therein, an evaporative fuel-guiding passage extending between said fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

negatively pressurizing means for bringing said evaporative emission control system into a predetermined negatively pressurized state;

parameter detecting means for detecting a value of at least one of a parameter representative of a running condition of said vehicle and at least one parameter representative of an internal state of said fuel tank, said parameters affecting pressure within said fuel tank and generation of evaporative fuel within said fuel tank, wherein said parameter representative of said running condition of said vehicle includes traveling speed of said vehicle; and abnormality determining means responsive to an output from said parameter detecting means, for determining whether there is an abnormality in said evaporative emission control system, based upon an output from said tank internal pressure detecting means, which is obtained when said evaporative emission control system has been brought into said predetermined negatively pressurized state, when said value of said at least one of said parameters detected by said parameter detecting means falls within a predetermined range.

13. In an evaporative fuel-processing system for an internal combustion engine installed in a vehicle and having an intake system, and a fuel tank, the system includes an evaporative emission control system including a canister having an air inlet port provided therein, an evaporative fuel-guiding passage extending between said fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

negatively pressurizing means for bringing said evaporative emission control system into a predetermined negatively pressurized state;

parameter detecting means for detecting a value of at least one of a parameter representative of a running condition of said vehicle and at least one parameter representative of an internal state of said fuel tank, said parameters affecting pressure within said fuel tank and generation of evaporative fuel within said fuel tank, wherein said at least one parameter representative of said internal state of said fuel tank includes temperature within said fuel tank; and abnormality determining means responsive to an output from said parameter detecting means, for determining whether there is an abnormality in said evaporative emission control system, based upon an output from said tank internal pressure detecting means, which is obtained when said evaporative emission control system has been brought into said predetermined negatively pressurized state, when said value of said at least one of said parameters detected by said parameter detecting means falls within a predetermined range.

14. In an evaporative fuel-processing system for an internal combustion engine installed in a vehicle and having an intake system, and a fuel tank, the system includes an evaporative emission control system including a canister having an air inlet port provided therein, an evaporative fuel-guiding passage extending between said fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

engine operation detecting means for detecting whether said engine is operating;

a third control valve for opening and closing said air inlet port of said canister;

negatively pressurizing means for bringing said evaporative emission control system into a predetermined negatively pressurized state by controlling said first to third control valves while said engine is detected to be operating;

parameter detecting means for detecting a value of at least one of a parameter representative of a running condition of said vehicle and at least one parameter representative of an internal state of said fuel tank, said parameters affecting pressure within said fuel tank and generation of evaporative fuel within said fuel tank; and abnormality determining means responsive to an output from said parameter detecting means, for determining whether there is an abnormality in said evaporative emission control system, based upon an output from said tank internal pressure detecting means, which is obtained when said evaporative emission control system has been brought into said predetermined negatively pressurized state, when said value of said at least one of said parameters detected by said parameter detecting means falls within a predetermined range.

15. In an evaporative fuel-processing system for an internal combustion engine installed in a vehicle and having an intake system, and a fuel tank, the system includes an evaporative emission control system including a canister having an air inlet port provided therein, an evaporative fuel-guiding passage extending between said fuel tank and said canister, a first control valve arranged across said evaporative fuel-guiding passage, a purging passage extending between said canister and said intake system of said engine, and a second control valve arranged across said purging passage, the improvement comprising:

tank internal pressure detecting means for detecting pressure within said fuel tank;

negatively pressurizing means for bringing said evaporative emission control system into a predetermined negatively pressurized state;

parameter detecting means for detecting a value of at least one of a parameter representative of a running condition of said vehicle and at least one parameter representative of an internal state of said fuel tank, said parameters affecting pressure within said fuel tank and generation of evaporative fuel within said fuel tank; and abnormality determining means responsive to an output from said parameter detecting means, for determining whether there is an abnormality in said evaporative emission control system, based upon an output from said tank internal pressure detecting means, which is obtained when said evaporative emission control system has been brought into said predetermined negatively pressurized state, when said value of said at least one of said parameters detected by said parameter detecting means falls within a predetermined range, wherein said abnormality determining means determines whether there is an abnormality in said evaporative emission control system, based upon a rate of change in said pressure within said fuel tank occurring with a lapse of time after said evaporative emission control system has been brought into said predetermined negatively pressurized state by said negatively pressurizing means, wherein said abnormality determining means compares said rate of change in said pressure within said fuel tank with a predetermined value which is set depending upon an amount of fuel within said fuel tank, and determines whether or not said evaporative emission control system is abnormal, based upon a result of said comparison.

16. In an evaporative fuel-processing system for an internal combustion engine installed in a vehicle and having an intake system, and a fuel tank, the system includes an evaporative emission control system including, said fuel tank, a canister having an air inlet port provided therein, an evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

pressure detecting means for detecting pressure within said evaporative emission control system;

negatively pressurizing means for bringing said evaporative emission control system into a predetermined negatively pressurized state;

vehicle speed detecting means for detecting traveling speed of said vehicle; and abnormality determining means responsive to an output from said vehicle speed detecting means, for determining whether there is an abnormality in said evaporative emission control system, based upon an output from said pressure detecting means, which is obtained when said evaporative emission control system has been brought into said predetermined negatively pressurized state, when it is detected from an output from said vehicle speed detecting means that said vehicle is standing.

17. In an evaporative fuel-processing system for an internal combustion engine installed in a vehicle and having an intake system, and a fuel tank, the system includes an evaporative emission control system including, said fuel tank, a canister having an air inlet port provided therein, and evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

pressure detecting means for detecting pressure within said evaporative emission control system;

negatively pressurizing means for bringing said evaporative emission control system into a predetermined negatively pressurized state;

tank temperature detecting means for detecting temperature within said fuel tank; and abnormality determining means responsive to an output from said tank temperature detecting means, for determining whether there is an abnormality in said evaporative emission control system, based upon an output from said pressure detecting means, which is obtained when said evaporative emission control system has been brought into said predetermined negatively pressurized state, when it is detected from an output from said tank temperature detecting means that an interior of said fuel tank is in a predetermined cold state.

18. In an evaporative fuel-processing system for an internal combustion engine installed in a vehicle and having an intake system, and a fuel tank, the system includes an evaporative emission control system including, said fuel tank, a canister having an air inlet port provided therein, an evaporative fuel-guiding passage extending between the fuel tank and said canister, a first control valve arranged across said evaporative fuel-guiding passage, a purging passage extending between said canister and said intake system of said engine, and a second control valve arranged across said purging passage, the improvement comprising:

pressure detecting means for detecting pressure within said evaporative emission control system;

negatively pressurizing means for bringing said evaporative emission control system into a predetermined negatively pressurized state;

vehicle speed detecting means for detecting traveling speed of said vehicle;

tank temperature detecting means for detecting temperature within said fuel tank;

fuel amount detecting means for detecting an amount of fuel within said fuel tank; and abnormality determining means responsive to an output from said detecting means, for determining whether there is an abnormality in said evaporative emission control system, based upon an output from said pressure detecting means, which is obtained when said evaporative emission control system has been brought into said predetermined negatively pressurized state, when it is detected from an output from at least one of said vehicle speed detecting means, said tank temperature detecting means, and said fuel amount detecting means that at least one of the following conditions is fulfilled:

said vehicle is standing;

an interior of said fuel tank is in a predetermined cold state; and said amount of fuel within said fuel tank falls within a predetermined range.

* * * * *